US007021179B2

(12) United States Patent
Sittig et al.

(10) Patent No.: US 7,021,179 B2
(45) Date of Patent: Apr. 4, 2006

(54) PRESSURE-OPERATED POWER SCREWDRIVER HAVING A MEASURING SECTION

(75) Inventors: Ulf Sittig, Siegburg (DE); Bernd Thelen, Much (DE)

(73) Assignee: Paul -Heinz Wagner, Much-Birrenbachshoehe (DE)

( * ) Notice: Subject to any disclaimer, the term of this patent is extended or adjusted under 35 U.S.C. 154(b) by 58 days.

(21) Appl. No.: 10/483,051

(22) PCT Filed: Jul. 3, 2002

(86) PCT No.: PCT/EP02/07357

§ 371 (c)(1),
(2), (4) Date: Jan. 7, 2004

(87) PCT Pub. No.: WO03/006208

PCT Pub. Date: Jan. 23, 2003

(65) Prior Publication Data

US 2004/0187650 A1 Sep. 30, 2004

(30) Foreign Application Priority Data

Jul. 7, 2001 (DE) ..... 201 11 326 U
Aug. 2, 2001 (DE) ..... 201 12 833 U

(51) Int. Cl.
*B25B 23/14* (2006.01)
*B25B 23/142* (2006.01)
*B25B 23/144* (2006.01)
*B25B 23/159* (2006.01)
*B25B 23/00* (2006.01)

(52) U.S. Cl. ..... 81/467; 81/478; 81/479; 81/481; 81/429; 81/57.39

(58) Field of Classification Search ..... 81/467, 81/478, 479, 481, 429, 57.39
See application file for complete search history.

(56) References Cited

U.S. PATENT DOCUMENTS 4,608,872 A * 9/1986 Mayer et al. ..... 73/862.23
4,794,826 A * 1/1989 Franks ..... 81/57.39
4,796,492 A * 1/1989 Liou ..... 81/58
5,457,866 A * 10/1995 Noda ..... 29/407.02
5,609,077 A * 3/1997 Ohmi et al. ..... 81/57.13

FOREIGN PATENT DOCUMENTS

WO WO 9739857 A1 * 10/1997

* cited by examiner

*Primary Examiner*—Joseph J. Hail, III
*Assistant Examiner*—Bryan Muller
(74) *Attorney, Agent, or Firm*—Diller, Ramik & Wight

(57) ABSTRACT

The power screwdriver comprises a functional part (11) with a housing (14) through which a shaft (17) passes. The shaft (17) is provided with a toothing (18), into which a ratchet lever of the functional part (11) engages. A splined shaft toothing (20) of the shaft (17) has an insertion recess (21) that changes into a cavity (22). The wall of the cavity (22) is provided with a torsion sensor (23) and forms a measuring section (25) that is located in the area of the shaft (17) covered by the housing (14). A torsion measurement is effected in the measuring section (25). Due to the measuring section (25) being located in the area of the shaft covered by the housing (14), the shaft (17) is relatively short whereby it may be used under tight spatial screwing conditions involving a low head height above the screw. The power wrench is additionally provided with an angle measuring device (33) whereby torque and angle of rotation can be simultaneously provided and can be used for controlling and recording.

14 Claims, 5 Drawing Sheets

18
14
17
23
20a
41
44
42
46
47
21
45
25
40
23

PRESSURE-OPERATED POWER SCREWDRIVER HAVING A MEASURING SECTION

BACKGROUND OF THE INVENTION

The invention relates to a pressure-operated hydraulic or pneumatic power wrench comprising a drive part and a functional part, said functional part having a shaft that is driven by a ratchet lever and includes a coupling device, and comprising a measuring section detecting the torsion element.

A hydraulic power wrench of this type is known from DE 296 07 207. In this power wrench, the shaft extends transversely through the housing of the functional part. Outside the housing, a measuring section adapted to be twisted is provided at the shaft. In this measuring section, a torsion sensor in the form of several extension measuring strips is mounted on the shaft. The torsion sensor forms an electric resistor arrangement the resistance of which depends on the torque. A coupling device adapted to be coupled with a tool or a screw head is located at the end of the shaft.

This power wrench with measuring cell permits to measure the torsional moment acting upon the screw whereby it is possible to detect the tightening torque directly at the screw connection.

It is the object of the invention to provide a pressure-operated power wrench with drive part, functional part and a measuring section, which has small dimensions in axial direction of the screw and thus can be used even if the headroom (above the screw) is small.

SUMMARY OF THE INVENTION

A first solution to this object is provided, according to the invention, by the features indicated in claim 1. Accordingly, the measuring section is arranged at least partially in the region enclosed by the housing. This means that the measuring section is located in the region covered by the housing or at least projects into this region. This results in that the shaft or a part connected thereto has a slight axial projection beyond the housing and that the overall length of the shaft is very small so that the power wrench can also be used at narrow locations with very small headroom being available above the screw.

A second solution to the indicated object is defined by claim 2. Accordingly, the measuring section is formed in a cavity of the shaft or a tubular portion connected thereto. Here, the torsion sensor of the measuring section is mounted to the inner wall of the cavity. At the outside of the shaft, no room is required for the torsion sensor. It can overlap with a toothing provided at the outside of the shaft and being engaged by the ratchet lever. Thus, the measuring section of the shaft does not require any additional length at all. Moreover, the torsion sensor is accommodated in the cavity so as to be protected against external influences and an additional encapsulation of the measuring section is not required.

A third solution to the object is defined by claim 3. Accordingly, the coupling device is configured as a key socket being an integral part of the shaft. Here, the projection of the shaft beyond the housing is reduced to a minimum measure. The cavity of the key socket may extend as far as into the housing. Alternatively, it is also possible to configure the coupling device as a square, for example, onto which a key socket can be put. In this case, however, the length of the shaft including the key socket becomes greater.

A fourth solution to the object is indicated in claim 4. Accordingly, the measuring section is arranged at or in a tubular portion of a key socket. The key socket may be an integral part of the shaft or may also be connected with the shaft.

At the housing, an angle sensor may be provided which detects the rotational angle of the shaft. Apart from the direct torque measurement in the interior of the apparatus, a direct rotational angle measurement is simultaneously effected. By integrating the angle sensor into the power wrench, the flat design is not substantially impaired so that the direct measurement can also be effected under extremely tight spatial conditions. It has been observed that the combined measurement of torque and rotational angle permits the most precise tightening method for highly sensitive screw connections.

Preferably, the angle sensor is arranged in a cap surrounding the one end of the shaft. Thus, the angle sensor is protected against mechanical damage and pollution. On the other hand, the lateral enlargement of the housing by the cap can be kept relatively small. Either by means of slip rings or by wireless transmission, data can be transferred through the cap.

Hereinafter, embodiments of the invention will be explained in detail with reference to the drawings.

In the Figures:

DETAILED DESCRIPTION OF THE PREFERRED EMBODIMENTS

Figure 2:
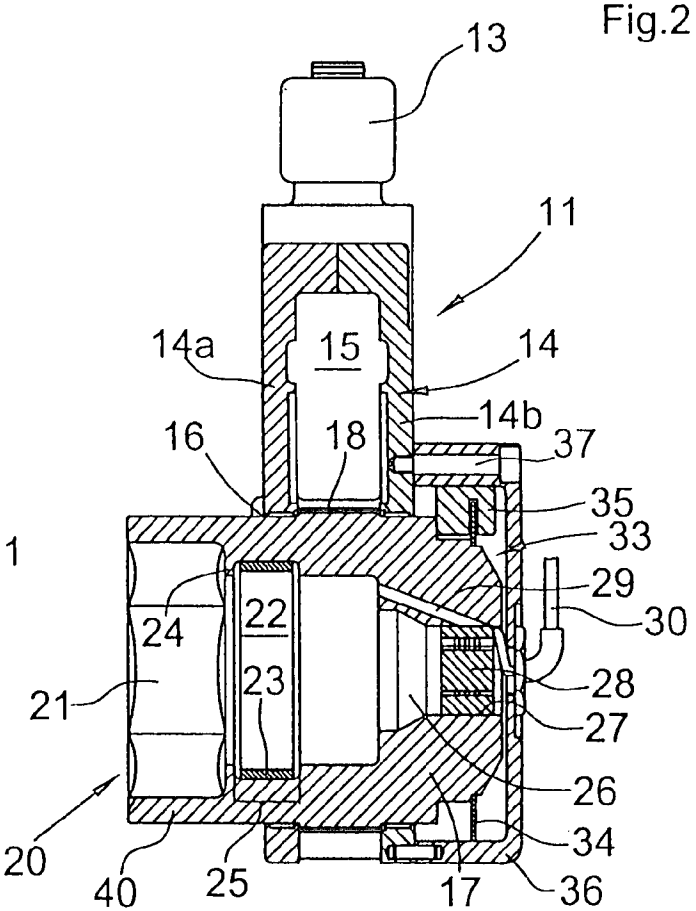
FIG. 2 shows a sectional view along the line II—II of FIG. 1.
Figure 1:
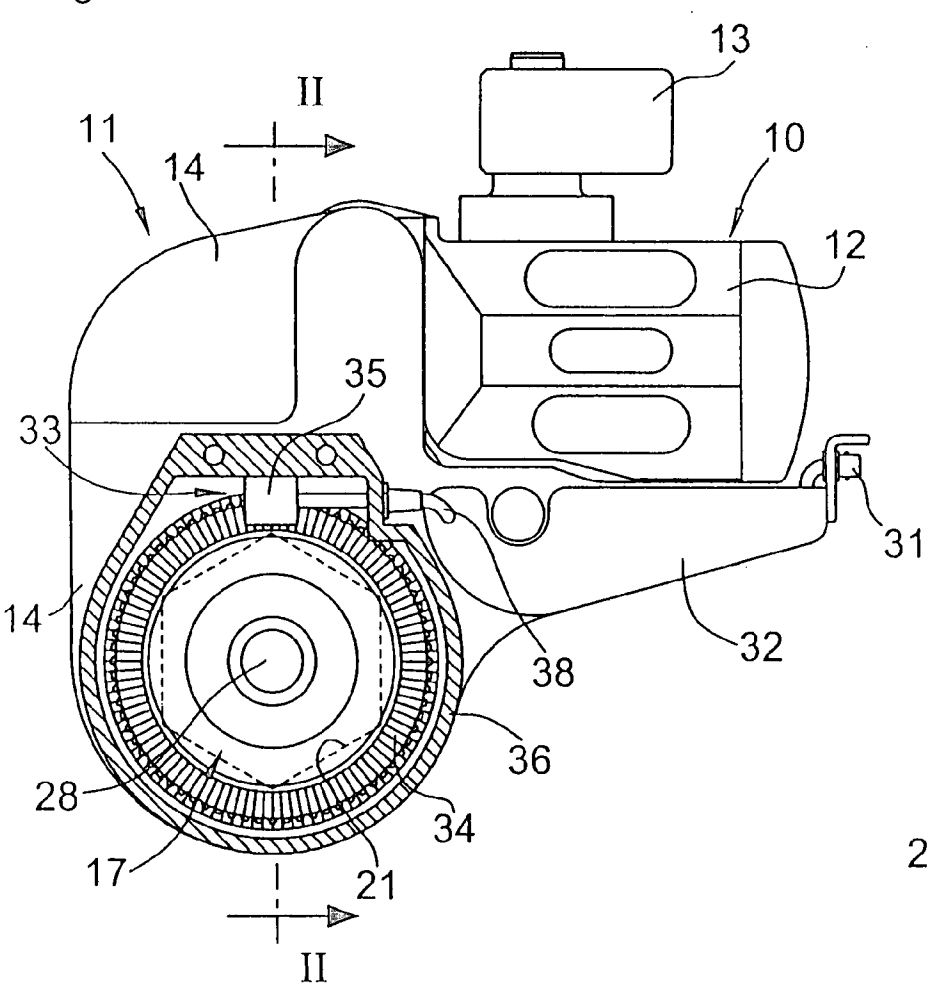
FIG. 1 shows a schematic side view of a first embodiment of the power wrench, partially in section.

The power wrench according to FIGS. 1 and 2 comprises a drive part 10 and a functional part 11. The drive part 10 is exchangeably mounted to the functional part 11. The drive part 10 includes a (non-illustrated) hydraulic cylinder in which a piston can be displaced. On the cylinder housing 12, the drive part 10 comprises a pivotal connection device 13 for hydraulic hoses.

The functional part 11 comprises a housing 14 consisting of two assembled housing halves 14*a* and 14*b* here. In the housing 14, there is a cavity 15 in which a (non-illustrated) ratchet lever can be pivoted to and fro by the drive part 10. A shaft 17 is rotatably supported in a transverse bore 16 extending through the housing 14. In the interior of the housing 14, this shaft 17 comprises a circumferential toothing 18 into which a toothing of the ratchet lever engages. Thus, the shaft 17 is rotated about its axis by a specified angular amount with each stroke of the drive part 10. Then, the return stroke of the ratchet lever is effected where the shaft 17 is not taken along.

At one end, the shaft 17 comprises a coupling device 20 configured as a key socket 40 and forming an insertion recess 21 of hexagonal cross section. The insertion recess 21 is located in the portion of the shaft 17 projecting from the housing 14 and extends as far as into the housing 14. Thus, the portion of the shaft projecting from the housing can be kept relatively short.

The insertion recess 21 changes into a cavity 22 formed in the shaft 17. The torsion sensor 23 in the form of extension measuring strips adhered to the circumferential wall is located at the circumferential wall of the cavity 22. Between the insertion recess 21 and the cavity 22, there is an annular flange 24 projecting inward and protecting the torsion sensor 23 against intrusions from outside. The portion of the shaft 17 carrying the torsion sensor 23 forms the measuring section 25. The cavity 22 forms an axial extension of the insertion recess 21. When the insertion recess 21 is put upon a screw nut to be turned, the cavity 22 is able to receive the screw shank projecting from the nut. Therefore, the insertion recess 21 may have a relatively small axial length. Alternatively, the insertion recess may also serve to receive the shank of a key socket or be configured as a square opening.

The cavity 22 is followed by a truncated transition 26 opening into a receiving room 27 in which a data transmission element 28 is included. From the torsion sensor 23, a cable duct 29 extends to the data transmission element 28. The data transmission element 28 is a slip ring arrangement, for example, which connects an external cable 30 with the torsion sensor 23 that is rotatable with the shaft 17. Alternatively, the transmission may also be effected in a wireless manner. The cable 30 leads to a cable connection 31 (FIG. 1) provided at a cantilever arm 32 of the housing 14, to which a control or measuring apparatus can be connected.

Further, the hydraulic power wrench is equipped with a rotational angle measuring device 33. The latter comprises a code disc 34 fastened on the end of the shaft 17 facing away from the insertion recess 21 and an angle sensor 35 reacting to the bars of the code disc 34 and detecting the rotational angle of the shaft thereby. The angle sensor 35 consists of a forkshaped light barrier into which the code disc 34 protruding radially from the shaft projects.

The angle sensor 35 is included in a cap 36 set upon a portion of the housing 14 and fastened by screws 37. The cap 36 encloses the rear end of the shaft 17 facing away from the insertion recess 21 and simultaneously forms a protective housing for this shaft end and the angle measuring device 33. From the angle sensor 35, a cable 38 leads to the cable connection 31 so that both the torsion sensor 23 and the angle sensor 35 are electrically accessible at the cable connection 31.

The operation of the power wrench can be exactly controlled and particularly, the desired screw tightening moment can be achieved purposefully with the torsion moment of the shaft 17 and the rotational angle of this shaft being continuously measured. It is also possible to store the data measured during a screw tightening process and deposit them in a memory to be able to document the screwing process later on. This is particularly important when screws relevant as to safety are tightened.

In the following embodiments, the drive part 10 and the functional part 11 each have the same construction as has been described with reference to FIGS. 1 and 2. What is different is the respective transmission of power from the shaft to the key socket, as will be explained hereinafter.

Figure 3:
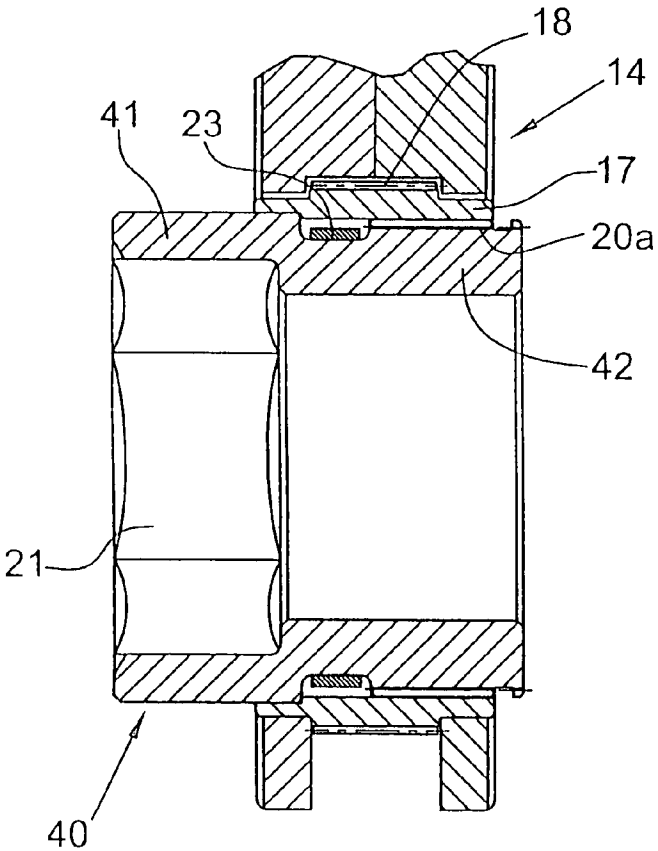
FIG. 3 shows a sectional view of a second embodiment where the measuring section is arranged on the outside of the shaft.

In the embodiment of FIG. 3, the shaft 17 is arranged in the housing over its entire length. On the one shaft half, it comprises a coupling device 20*a* in the form of a splined shaft toothing engaging with a corresponding outer toothing of a key socket 40. The key socket 40 has a hexagonal insertion recess 21 in an enlarged head 41. The head 41 partially extends as far as into the housing 14. The head 41 is followed by a hollow shaft 42. This hollow shaft comprises an outer wedge splining engaging with the coupling device 20*a* of the shaft 17. Between this outer wedge splining and the head 41, there is a measuring section 25 with a torsion sensor 23 arranged in the annular groove of the hollow shaft 42 so as to be countersunk. The torque is transferred to the hollow shaft 42 from the shaft 17, and from there, it is transferred to the head 41 of the key socket 40 via the measuring section 25. In this variant, even a part of the head 41 is arranged so as to be countersunk in the housing 14 so that the axial length of the power wrench can be kept extremely short.

Figure 4:
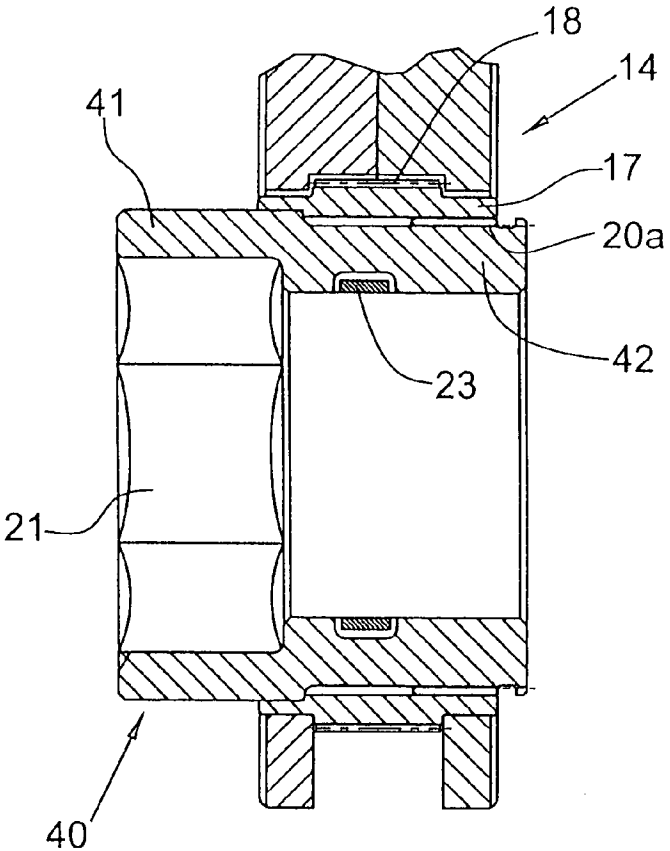
FIG. 4 shows a sectional view of a third embodiment where the measuring section is arranged in the shaft interior.

The embodiment of FIG. 4 corresponds to that of FIG. 3, but with the difference that the torsion sensor 23 is arranged at the inside of the hollow shaft 42. Electric connection lines can be led through the hollow shaft to the torsion sensor very easily.

Figure 5:
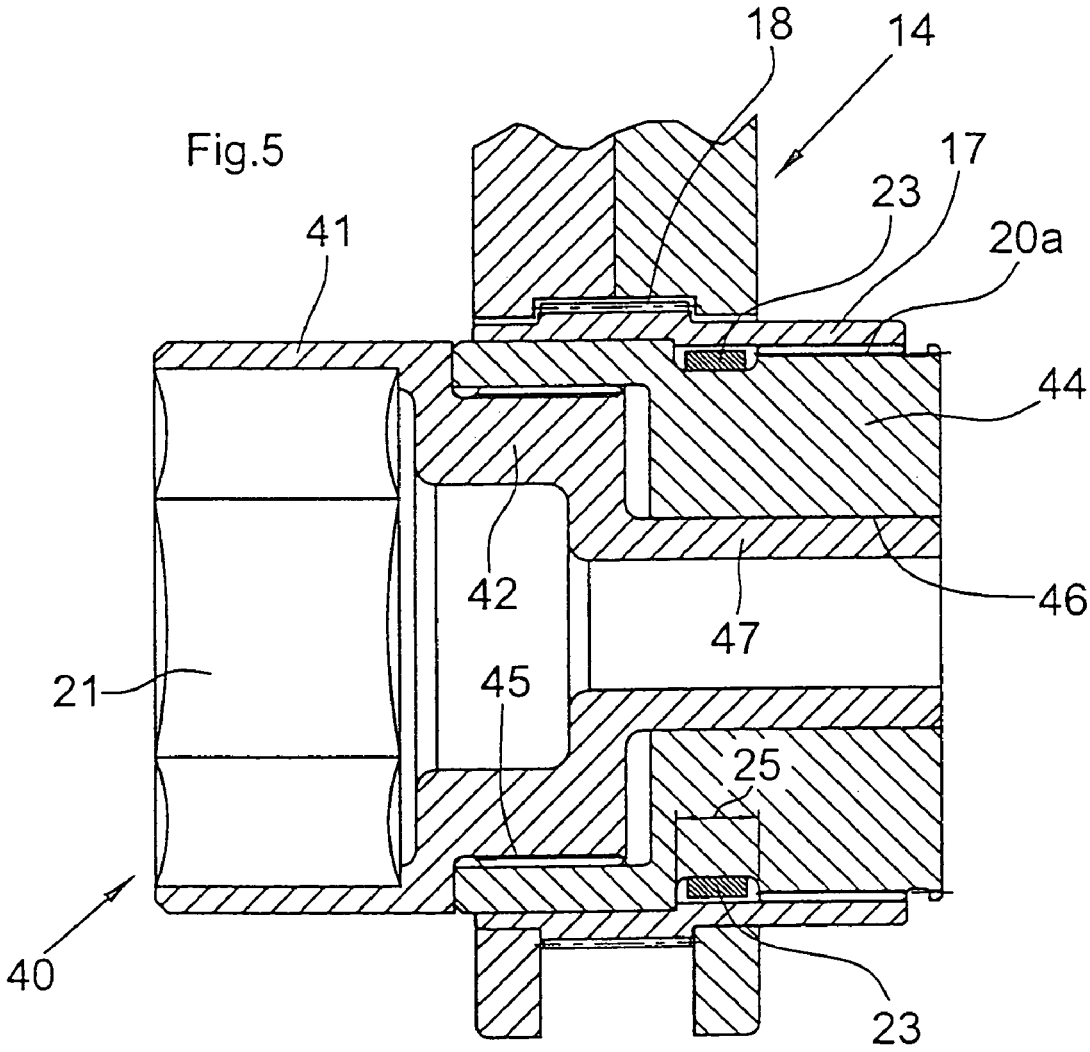
FIG. 5 shows a sectional view of a fourth embodiment where the shaft is coupled with the key socket via an intermediate shaft.

In the embodiment of FIG. 5, the shaft 17 projects from the housing 14 toward the rear end. At the projecting portion, it is provided with a splined shaft toothing 20*a* at the inside, which engages with a corresponding coupling device 20*a* at the outside of an intermediate shaft 44. The intermediate shaft extends through the housing 14 as far as to the front and it comprises an inner splined shaft toothing 45 in its front portion and a bearing bore 46 in its rear portion.

The key socket 40 comprises a head 41 with an insertion recess 21. This head is followed by a hollow shaft 42 on which a splined shaft section is provided which engages with the splined shaft toothing 45 of the intermediate shaft 44. The hollow shaft 42 is followed by a hollow shaft section 47 supported in the bearing bore 46.

In the region between the two splined shaft toothings 20*a* and 45, there is the measuring section 25 with the torsion sensor 23 fastened in an outer groove of the intermediate shaft 44.

In the embodiment according to FIG. 5, key socketes 40 of different wrench widths can be inserted into the intermediate shaft, even the largest wrench widths being possible.

The embodiment of FIG. 5 may also be modified such that the torsion sensor 23 is included in a recess at the inner wall of the intermediate shaft 44.

Figure 6:
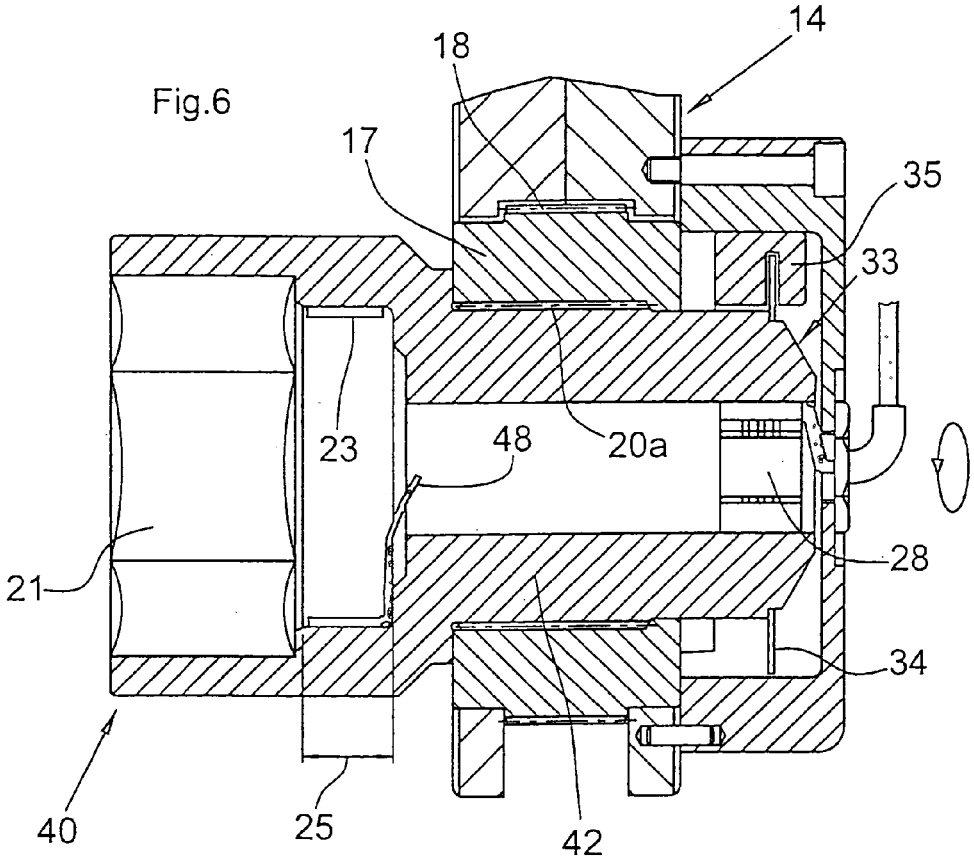
FIG. 6 shows a fifth embodiment where the measuring section is arranged in a tubular portion of the key socket.

FIG. 6 shows an embodiment where the key socket 40 is connected with a hollow shaft 42 which engages into an inner coupling device 20*a* of the shaft 17. The shaft 17 extends over the width of the housing 14, but does not project substantially beyond it. With the hollow shaft 42, the key socket 40 forms a structural unit which, as a whole, can be withdrawn from the shaft 17. The measuring section 25 is located at the key socket 40, namely in the region between the insertion recess 21 and the hollow shaft 42. From the torsion sensor 23, electric wires 48 extend through the hollow shaft to a data transmission element 28 arranged in the same manner as in FIG. 2, but being located in the interior of the hollow shaft 42 here. The power wrench is equipped with a rotational angle measuring device 33 comprising a code disc 34 seated on the hollow shaft 42 and an angle sensor 35 secured to the housing.

Figure 7:
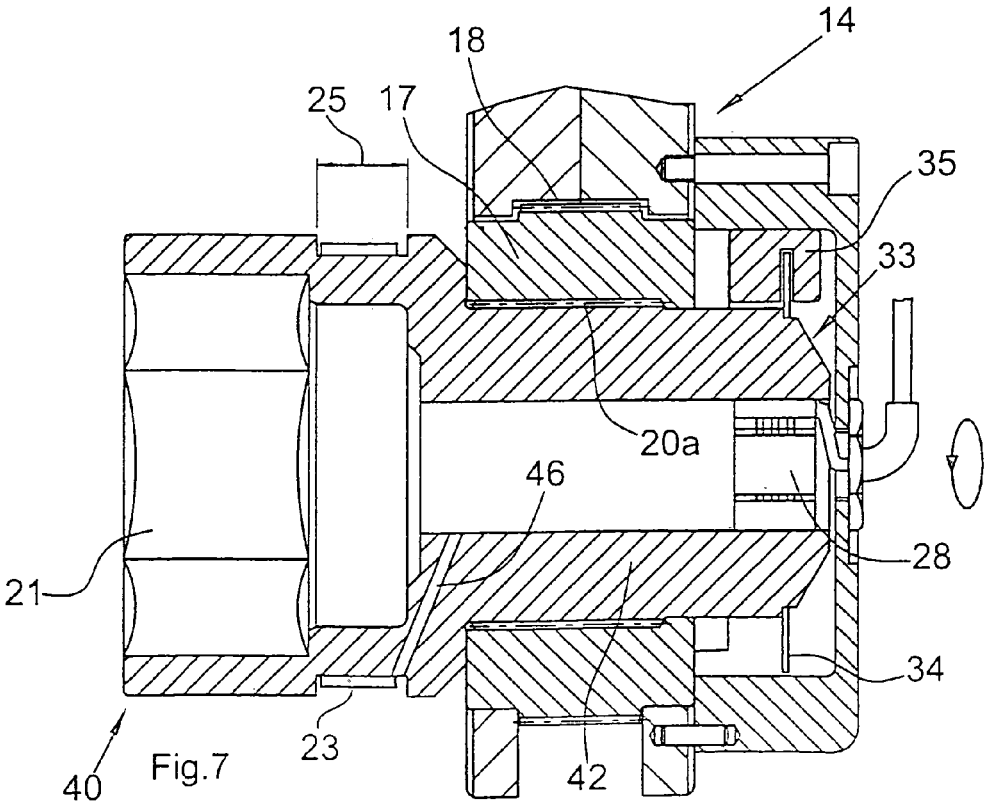
FIG. 7 shows a sixth embodiment where the measuring section is arranged on the outside of a tubular portion of the key socket.

The embodiment of FIG. 7 differs from that of FIG. 6 only in that the torsion sensor 23 is arranged on the outside of the measuring section 25. A bore 46 for the passage of the cables from the torsion sensor 23 leads through the hollow shaft 42 into the interior of the hollow shaft.

Figure 8:
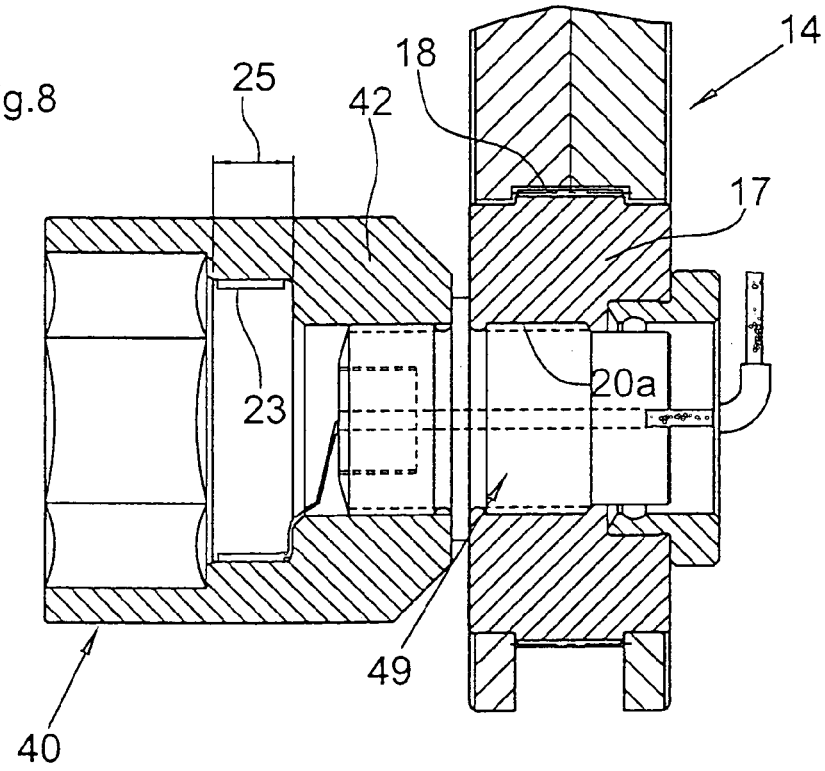
FIG. 8 shows a seventh embodiment where the measuring section is arranged in a tubular portion of the key socket which, in turn, is connected with an intermediate shaft.

FIG. 8 shows an embodiment where the key socket 40 is extended by a hollow shaft 42 including a measuring section 25, the torsion sensor 23 being arranged in the interior of the hollow shaft 42. The hollow shaft 42 is connected with an intermediate shaft 49 engaging into an inner coupling device 20*a* of the shaft 17. The cable from the torsion sensor 23 passes through the intermediate shaft 49 in order to emerge at the rear side.

Figure 9:
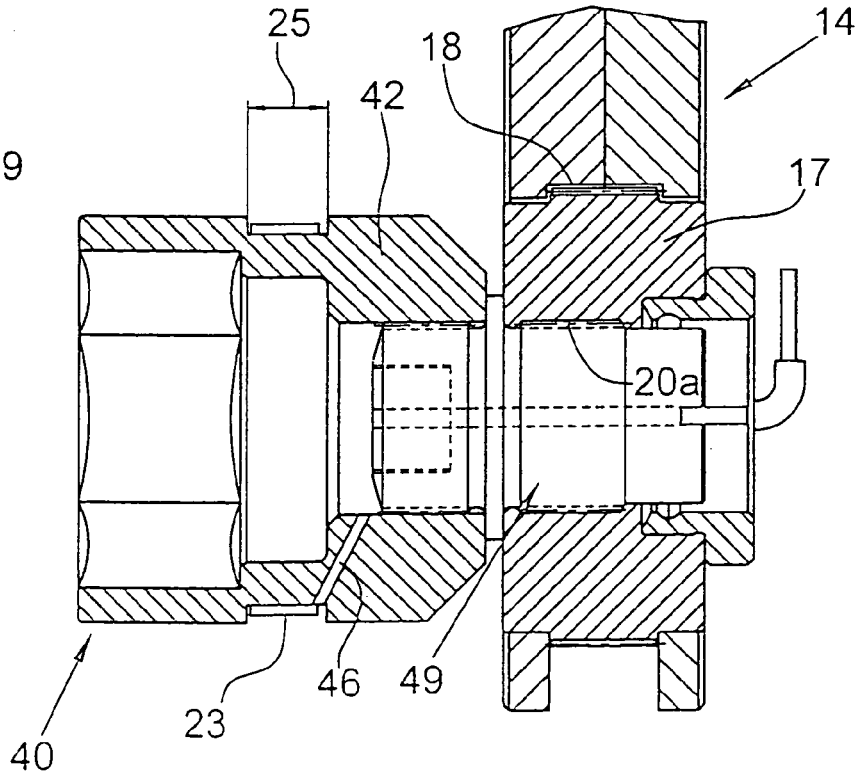
FIG. 9 shows a version similar to that of FIG. 8, but with the measuring section being arranged outside.

The embodiment of FIG. 9 differs from that of FIG. 8 only in that the torsion sensor 23 is arranged on the outside of the measuring section 25. From there, a bore 46 leads into the interior of the hollow shaft 42.

Although a preferred embodiment of the invention has been specifically illustrated and described herein, it is to be understood that minor variations may be made in the apparatus without departing from the spirit and scope of the invention, as defined by the appended claims.

What is claimed is:

1. A pressure-operated power wrench comprising a drive part (10) and a functional part (11) having a housing (14) that includes a ratchet lever driven by the drive part (10), said ratchet lever driving a drive shaft (17) that extends transversely through the housing (14) and comprises a coupling section (20; 20*a*), said power wrench comprising a measuring section (25) having a torsion sensor (23) positioned on said drive shaft (17) for measuring the torque of said drive shaft (17), characterized in that the torsion sensor (23) is on said drive shaft (17) arranged at least partially within a region between said drive shaft (17) and the housing (14).

2. A pressure-operated power wrench comprising a drive part (10) and a functional part (11) having a housing (14) that includes a ratchet lever driven by the drive part (10), said ratchet lever driving a drive shaft (17) that extends transversely through the housing (14) and comprises a coupling section (20; 20*a*), said power wrench comprising a measuring section (25) having a torsion sensor (23) for measuring the torque of said drive shaft (17), characterized in that the measuring section (25) is formed at an internal cavity (22) provided by a bore within the drive shaft (17).

3. A pressure-operated power wrench comprising a drive part (10) and a functional part (11) having a housing (14) that includes a ratchet lever driven by the drive part (10), said ratchet lever driving a drive shaft (17) that extends transversely through the housing (14) and comprises a coupling section (20; 20*a*), said power wrench comprising a measuring section (25) having a torsion sensor (23) positioned for measuring torque, characterized in that the torsion sensor (23) is arranged at or in a hollow shaft (42) of a key socket (40) and at least partially in a region of said key socket (40) enclosed by the housing (14).

4. The power wrench according to claim 2, characterized in that the cavity (22) immediately follows an insertion recess (21) of the coupling device (20).

5. The power wrench according to claim 1, characterized in that an angle sensor (35) for detecting the rotational angle of the drive shaft (17) is provided at the housing (14).

6. The power wrench according to claim 5, characterized in that the angle sensor (35) is arranged in a cap (36) enclosing the one end of the drive shaft (17).

7. The power wrench according to claim 1, characterized in that an angle sensor (35) for detecting the rotational angle of the drive shaft (17) cooperates with a code disc (34) fastened on the end of the drive shaft (17).

8. The power wrench according to claim 1, characterized in that a data transmission element (28) is arranged at the end of the drive shaft (17).

9. The power wrench according to claim 2, characterized in that an angle sensor (35) for detecting the rotational angle of the drive shaft (17) is provided at the housing (14).

10. The power wrench according to claim 3, characterized in that an angle sensor (35) for detecting the rotational angle of the drive shaft (17) is provided at the housing (14).

11. The power wrench according to claim 9, characterized in that the angle sensor (35) cooperates with a code disc (34) fastened on the end of the drive shaft (17).

12. The power wrench according to claim 10, characterized in that the angle sensor (35) cooperates with a code disc (34) fastened on the end of the drive shaft (17).

13. The power wrench according to claim 2, characterized in that a data transmission element (28) is arranged at the end of the drive shaft (17).

14. The power wrench according to claim 3, characterized in that a data transmission element (28) is arranged at the end of the drive shaft (17).

* * * * *